US008678616B2

(12) United States Patent
Marquardt et al.

(10) Patent No.: US 8,678,616 B2
(45) Date of Patent: Mar. 25, 2014

(54) LED LUMINAIRE FOR DISPLAY CASES

(75) Inventors: Craig Eugene Marquardt, Covington, GA (US); Miguel Angel Ibanez, Griffin, GA (US); Daniel Edward Sicking, Lawrenceville, GA (US); Michael Ray Miller, Conyers, GA (US)

(73) Assignee: ABL IP Holding LLC, Conyers, GA (US)

( * ) Notice: Subject to any disclaimer, the term of this patent is extended or adjusted under 35 U.S.C. 154(b) by 291 days.

(21) Appl. No.: 13/080,203

(22) Filed: Apr. 5, 2011

(65) Prior Publication Data

US 2011/0199767 A1 Aug. 18, 2011

Related U.S. Application Data

(63) Continuation-in-part of application No. 12/840,704, filed on Jul. 21, 2010.

(60) Provisional application No. 61/271,428, filed on Jul. 21, 2009.

(51) Int. Cl.
*F21V 33/00* (2006.01)

(52) U.S. Cl.
USPC ..... 362/235; 362/238

(58) Field of Classification Search
USPC ..... 362/235, 238, 240–243, 247, 247.02, 362/247.06, 341, 345
See application file for complete search history.

(56) References Cited

U.S. PATENT DOCUMENTS 845,652 A 2/1907 La Berge
1,149,140 A 8/1915 Hess
3,617,729 A 11/1971 Lassen
3,886,348 A 5/1975 Jonathan et al.
4,598,341 A 7/1986 Brackhahn et al.
4,689,726 A 8/1987 Kretzschmar
4,739,454 A 4/1988 Federgreen
4,748,545 A 5/1988 Schmitt (Continued)

FOREIGN PATENT DOCUMENTS

EP 0303741 2/1989
EP 1627583 2/2006

(Continued)

OTHER PUBLICATIONS

Non-Final Office Action for U.S. Appl. No. 12/840,704, mailed Nov. 26, 2012.

(Continued)

*Primary Examiner* — Vip Patel
(74) *Attorney, Agent, or Firm* — Kilpatrick Townsend & Stockton, LLP

(57) ABSTRACT

A lighting luminaire for use in a refrigerated display case includes an LED mounting portion comprising a plurality of light emitting diodes ("LEDs") mounted thereon, a reflector, and a lens. The LED mounting portion and reflector are sized and arranged to form a reflective cavity for diffusing and directing light from the plurality of LEDs through the lens and out of the luminaire. The LED mounting portion and reflector are either attached to each other as separate components or are integrally formed. The lens is held in place in the luminaire between the LED mounting portion and the reflector or is mounted directly on the LED mounting portion over the plurality of LEDs. The LED mounting portion and/or reflector have a reflective surface for reflecting light emitted by the LEDs. Methods for retrofitting an existing luminaire in a refrigerated display with an LED luminaire are also provided.

13 Claims, 16 Drawing Sheets

(56) References Cited

U.S. PATENT DOCUMENTS

| | | | |
|---|---|---|---|
| 4,799,133 | A | 1/1989 | Strzalko et al. |
| 4,973,796 | A | 11/1990 | Dougherty et al. |
| 4,979,078 | A | 12/1990 | Amstutz et al. |
| 5,022,720 | A | 6/1991 | Fevig et al. |
| 5,034,861 | A | 7/1991 | Sklenak et al. |
| 5,040,101 | A | 8/1991 | Aspenwall |
| 5,054,863 | A | 10/1991 | Amstutz et al. |
| 5,057,978 | A | 10/1991 | Conti |
| 5,072,343 | A | 12/1991 | Buers |
| D330,090 | S | 10/1992 | Walter et al. |
| 5,180,222 | A | 1/1993 | Robinson |
| 5,205,638 | A | 4/1993 | Squitieri |
| D344,605 | S | 2/1994 | Aspenwall |
| 5,437,504 | A | 8/1995 | Halvatzis |
| 5,471,372 | A | 11/1995 | Mamelson et al. |
| 5,508,898 | A | 4/1996 | Mc Govern |
| 5,722,747 | A | 3/1998 | Baron |
| 5,836,669 | A | 11/1998 | Hed |
| 5,873,646 | A | 2/1999 | Fjaestad et al. |
| 5,879,070 | A | 3/1999 | Severloh |
| 5,895,111 | A | 4/1999 | Santosuosso et al. |
| 5,902,034 | A | 5/1999 | Santosuosso et al. |
| 5,904,257 | A | 5/1999 | Marmet et al. |
| 6,042,244 | A | 3/2000 | Witkoski |
| 6,179,434 | B1 | 1/2001 | Saraiji |
| D440,335 | S | 4/2001 | Kuo |
| 6,210,013 | B1 | 4/2001 | Bousfield |
| 6,211,626 | B1 | 4/2001 | Lys et al. |
| 6,231,205 | B1 | 5/2001 | Slesinger et al. |
| 6,283,608 | B1 | 9/2001 | Straat |
| 6,292,901 | B1 | 9/2001 | Lys et al. |
| 6,302,557 | B1 | 10/2001 | Santosuosso et al. |
| D450,874 | S | 11/2001 | Heiny et al. |
| 6,325,523 | B1 | 12/2001 | Santosuosso et al. |
| 6,340,868 | B1 | 1/2002 | Lys et al. |
| 6,401,969 | B1 | 6/2002 | Yajima et al. |
| 6,406,108 | B1 | 6/2002 | Upton et al. |
| 6,459,919 | B1 | 10/2002 | Lys et al. |
| 6,478,444 | B2 | 11/2002 | Schaerer et al. |
| 6,478,445 | B1 | 11/2002 | Lange et al. |
| 6,510,995 | B2 | 1/2003 | Muthu et al. |
| 6,533,130 | B1 | 3/2003 | Padiak et al. |
| 6,550,269 | B2 | 4/2003 | Rudick |
| 6,558,017 | B1 | 5/2003 | Saraiji et al. |
| 6,566,824 | B2 | 5/2003 | Panagotacos et al. |
| 6,578,978 | B1 | 6/2003 | Upton et al. |
| 6,578,979 | B2 | 6/2003 | Truttmann-Battig |
| 6,632,100 | B1 | 10/2003 | Richardson |
| 6,638,088 | B1 | 10/2003 | Richardson |
| 6,641,419 | B1 | 11/2003 | Richardson |
| 6,663,273 | B2 | 12/2003 | Robey |
| 6,726,341 | B2 | 4/2004 | Pashley et al. |
| D489,472 | S | 5/2004 | Newhouse et al. |
| D493,009 | S | 7/2004 | Ken |
| 6,773,130 | B1 | 8/2004 | Richardson |
| 6,808,285 | B2 | 10/2004 | Shemitz |
| 6,827,463 | B2 | 12/2004 | Chuang et al. |
| 6,827,465 | B2 | 12/2004 | Shemitz et al. |
| 6,834,452 | B2 | 12/2004 | Martin et al. |
| 6,869,154 | B2 | 3/2005 | Vandenbussche |
| 6,951,402 | B1 | 10/2005 | Copp |
| 6,997,007 | B1 | 2/2006 | Wyatt |
| D521,286 | S | 5/2006 | Colmenares |
| 7,036,947 | B2 | 5/2006 | Chuang et al. |
| 7,038,398 | B1 | 5/2006 | Lys et al. |
| 7,121,675 | B2 | 10/2006 | Ter-Hovhannisian |
| 7,131,746 | B2 | 11/2006 | Cook |
| 7,157,667 | B2 | 1/2007 | Gramlich et al. |
| 7,163,305 | B2 | 1/2007 | Bienick |
| 7,201,487 | B2 | 4/2007 | Pinter |
| D553,287 | S | 10/2007 | Miller |
| 7,281,811 | B2 | 10/2007 | Rann et al. |
| 7,284,876 | B2 | 10/2007 | Ericson |
| 7,559,672 | B1 | 7/2009 | Parkyn et al. |
| 7,950,817 | B2 | 5/2011 | Zulim et al. |
| 2004/0066646 | A1 | 4/2004 | Chuang et al. |
| 2005/0030736 | A1 | 2/2005 | Chuang et al. |
| 2005/0185395 | A1 | 8/2005 | Pinter |
| 2005/0265019 | A1 | 12/2005 | Sommers et al. |
| 2006/0012722 | A1 | 1/2006 | Ouchi et al. |
| 2006/0209537 | A1 | 9/2006 | Stelmasik et al. |
| 2006/0242981 | A1 | 11/2006 | Grassmuck et al. |
| 2007/0058369 | A1 | 3/2007 | Parkyn et al. |
| 2007/0064428 | A1 | 3/2007 | Beauchamp |
| 2007/0070615 | A1 | 3/2007 | Daniel et al. |
| 2007/0151274 | A1 | 7/2007 | Roche et al. |
| 2007/0195535 | A1 | 8/2007 | Artwohl et al. |
| 2007/0247831 | A1 | 10/2007 | Buelow, II et al. |
| 2007/0256340 | A1 | 11/2007 | Kim |
| 2008/0007945 | A1 | 1/2008 | Kelly et al. |
| 2008/0012722 | A1 | 1/2008 | Moseley |
| 2008/0094824 | A1 | 4/2008 | Stack et al. |
| 2008/0259593 | A1 | 10/2008 | Reese |
| 2009/0002990 | A1 | 1/2009 | Becker et al. |
| 2009/0091271 | A1 | 4/2009 | Zulim et al. |
| 2009/0196022 | A1 | 8/2009 | Kelly et al. |
| 2011/0019410 | A1 | 1/2011 | Ibanez et al. |

FOREIGN PATENT DOCUMENTS

| | | |
|---|---|---|
| EP | 1761146 | 3/2007 |
| FR | 2654602 | 5/1991 |
| GB | 952388 | 3/1964 |
| GB | 1379276 | 1/1975 |
| GB | 2133196 | 7/1984 |
| GB | 2430536 | 3/2007 |
| JP | 55091229 | 7/1980 |
| JP | 08146888 | 6/1996 |
| JP | 2000175794 | 6/2000 |
| JP | 2001141351 | 5/2001 |
| JP | 2001215076 | 8/2001 |
| JP | 2001291085 | 10/2001 |
| JP | 2002078579 | 3/2002 |
| JP | 2002168558 | 6/2002 |
| JP | 2003233893 | 8/2003 |
| JP | 2002147945 | 5/2005 |
| JP | 2005285701 | 10/2005 |
| JP | 2006092900 | 4/2006 |
| JP | 2006166948 | 6/2006 |
| JP | 2006334275 | 12/2006 |
| JP | 2007117702 | 5/2007 |
| JP | 2008033053 | 8/2008 |
| WO | WO 9318499 | 9/1993 |
| WO | WO 9421961 | 9/1994 |
| WO | WO 9738610 | 6/1999 |
| WO | WO 9931560 | 6/1999 |
| WO | WO 0184985 | 11/2001 |
| WO | WO 2005119124 | 12/2005 |
| WO | WO 2006086998 | 8/2006 |
| WO | WO 2006087000 | 8/2006 |
| WO | WO 2007004615 | 1/2007 |
| WO | WO 2008007297 | 1/2008 |
| WO | WO 2008047335 | 4/2008 |

OTHER PUBLICATIONS

Non-Final Office Action in U.S. Appl. No. 12/175,063 mailed from the U.S. Patent and Trademark Office on Sep. 28, 2010.

Office Action in U.S. Appl. No. 12/164,822 mailed from the U.S. Patent and Trademark Office on Apr. 14, 2010.

Response to Office Action filed Aug. 13, 2010 in U.S. Appl. No. 12/164,822.

"Display Case Lighting", www.residential-landscape-lighting.com/display-case-lighting.htm, 2002-2008, 2 sheets.

"Display Case Lighting", http://Kevan-Shaw.com/pdf/display_case.pdf, Dec. 21, 2007, 5 sheets.

"Exhibition Lighting a Full Range", www.cokerexpo.co.uk/lighting.htm, Jul. 11, 2007, 13 sheets.

Final Office Action in U.S. Appl. No. 12/164,822 mailed from the U.S. Patent and Trademark Office on Nov. 9, 2010.

"Hasting Lighting Company—Showcase Lighting, Display Case Lighting", www.hastingslighting.com, Product Catalog, 23 sheets.

(56) References Cited

OTHER PUBLICATIONS

"LED Museum Display Case Lighting", www.ledlightingfactory.com, Apr. 28, 2007, 4 sheets.
"Lighting Resource Product Search—Accent Lighting. Display Case", www.lightingresource.com/applications/17, Oct. 9, 1999, 40 sheets.
"Tradeshow Cases and Exhibit Cases—Display Cases —Lighting Cases", www.starcase.com/tradeshowandexhibitcases.htm, Jun. 1, 2000, 5 sheets.
"XPO Display Case Lighting", www.visual-lighting.com/downloads/cutSheets/6101.pdf, 1999-2006, 38-39.
Non-Final Office Action for U.S. Appl. No. 12/164,822, mailed Sep. 8, 2011.
Amendment and Response to Office Action for U.S. Appl. No. 12/164,822, filed May 9, 2011.
Notice of Allowance for U.S. Appl. No. 12/175,063, mailed Jan. 20, 2011.
Amendment and Response to Non-Final Office Action for U.S. Appl. No. 12/175,063, filed Dec. 22, 2010.
International Search Report for PCT/US/06074, mailed Sep. 12, 1997.

LED LUMINAIRE FOR DISPLAY CASES

CROSS REFERENCE TO RELATED APPLICATION

This application is a continuation-in-part of U.S. patent application Ser. No. 12/840,704, filed Jul. 21, 2010, which claims the benefit of U.S. Provisional application Ser. No. 61/271,428, filed Jul. 21, 2009, the entire contents of which are incorporated herein by reference.

FIELD OF THE INVENTION

The present invention relates to light-emitting diode ("LED") luminaires, and in particular LED luminaires adaptable for use in refrigerated display cases.

BACKGROUND OF THE INVENTION

Display cases, including refrigerated display cases, historically have used fluorescent sources to light the interior of the case. However, the fluorescent bulbs used in such applications have limited life and must be replaced often. The electrodes in fluorescent bulbs are easily burnt out or broken, requiring that the entire bulb be replaced. Moreover, the glass bulbs themselves are susceptible to breakage.

The fluorescent bulbs have been positioned in various locations within the cases, including at the top and along the underside of shelves within the case. A lamp provided at the top of the unit illuminates the products positioned near the top of the case, but fails to adequately illuminate those products positioned lower within the case. This is particularly true if all of the shelves have the same depth. The use of a lamp positioned along the underside of shelf within the case helps illuminate the products located on a shelf below the lamp. Yet, the use of multiple lamps increases the energy and thus cost needed to adequately illuminate the case. There is a need to illuminate products with a display case more efficiently and effectively.

LED strip luminaires have been used to replace fluorescent lamps for illuminating merchandise in display cases. Typically, lenses, diffusers, and/or covers are positioned in close proximity to the LEDs to direct the light emitted from the LEDs directly on the products being displayed. In this way, such LEDs provide non-uniform, direct illumination of merchandise.

SUMMARY OF EMBODIMENTS OF THE INVENTION

In one embodiment, a lighting luminaire includes an LED mounting portion comprising a plurality of LEDs mounted thereon, a reflector, and a lens. The LED mounting portion and reflector are sized and arranged to form a reflective cavity for diffusing and directing light from the plurality of LEDs through the lens and out of the luminaire.

In an embodiment, the LED mounting portion and reflector are attached to each other as separate components or are integrally formed. In another embodiment, if the LED mounting portion and reflector are separate components the LED mounting portion can include a slot for receiving the reflector and attaching the reflector thereto.

In yet other embodiments, the lens is held in place in the luminaire between the LED mounting portion and the reflector or is mounted directly on the LED mounting portion over the plurality of LEDs. In a further embodiment, the lens is clear or is refractive with a symmetrical, asymmetrical or non-symmetrical light output.

In some embodiments, the LED mounting portion and/or reflector have a reflective surface for reflecting light from the plurality of LEDs. In some embodiments the reflective surface is a reflective paint or a reflective liner In further embodiments the LED mounting portion and reflector are attached to each other via engagement of a ball or socket on the LED mounting portion with a corresponding socket or ball on the reflector. In certain embodiments, the reflector is repositionable within the luminaire so as to allow the direction of light exiting the luminaire to be adjusted.

In other embodiments the luminaire can further include one or more fins for dissipating heat generated by the plurality of LEDs away from the luminaire. In yet other embodiments the LED mounting portion can further include at least one void or offset to further promote dissipation of heat generated by the LEDs.

In some embodiments the luminaire is mounted on a shelf, such as a shelf of a refrigerated display case. A thermal insulation pad may be located between the luminaire and the shelf to minimize heat transfer from the luminaire to the shelf. In certain high-humidity environments, the luminaire can include one or more water shedding surfaces for directing condensation away from the LEDs and off the luminaire.

In a further embodiment, an existing luminaire in a refrigerated display is retrofitted with an LED luminaire.

DETAILED DESCRIPTION OF EMBODIMENTS OF THE INVENTION

Figure 1:
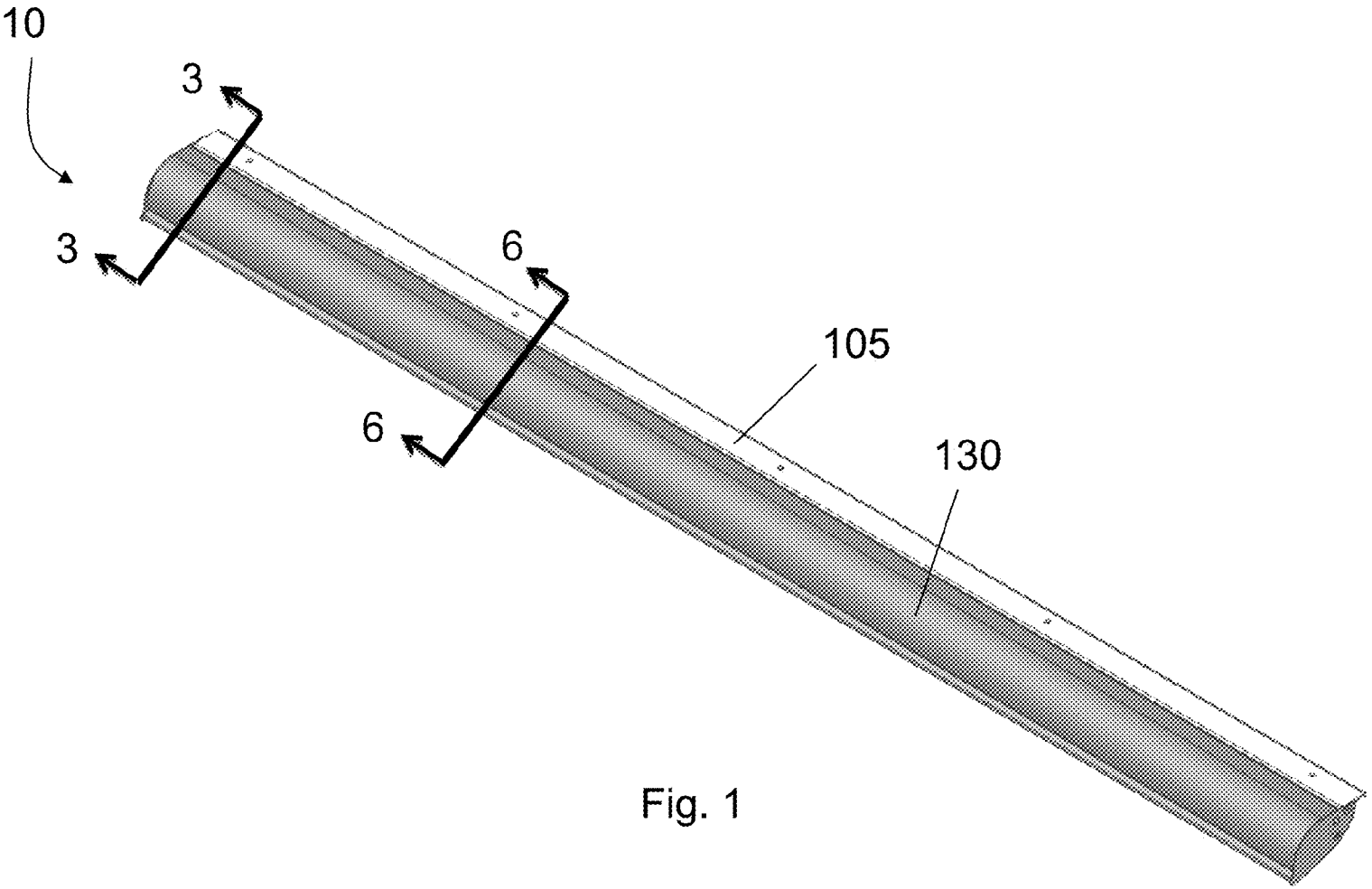
FIG. 1 is a perspective view of a luminaire according to one embodiment of the invention.

Embodiments of the present invention overcome traditional spotty illumination and striations by occluding the direct point-source lighting with an integral, highly-reflective diffuse optical reflector that provides uniform illumination and color temperature to products positioned within the display. More specifically, embodiments of the present invention use LEDs positioned to emit light into a reflective cavity. In one embodiment, the LEDs are positioned on the surface of an LED mounting portion so as to direct emitted light into a reflective cavity.

FIGS. 1-7 illustrate one embodiment of the luminaire 10 of the present invention. The luminaire 10 includes an LED mounting portion 100 with LEDs 110 mounted on the LED mounting portion 100, a reflector 130, and a lens 150. The reflector 130 is preferably curved and includes a first edge 132, a second edge 134, and a reflective inner surface 136. Both the LED mounting portion 100 and the reflector 130 can be formed of any suitable material but in some embodiments may be formed of extruded aluminum. In one embodiment, the LED mounting portion 100 acts as a heat sink for removing heat generated by the LEDs 110 mounted thereon. In some embodiments, the reflector 130 can, but need not, act as a heat sink and can thus be thinner than the LED mounting portion 100.

The reflector 130 is preferably treated so as to render its inner surface 136 highly diffusely reflective, preferably, but not necessarily, between 96%-99.5%, inclusive and more preferably 98.5-99% reflective. To achieve the desired reflectivity, in one embodiment the inner surface 136 of the reflector 130 is coated with a highly reflective material, including, but not limited to, paints sold under the tradenames GL-22, GL-80 and GL-30, all available from DuPont. Other embodiments may utilize textured or colored paints or impart a baffled shape to the reflector surface to obtain a desired reflection. Alternatively, a reflective liner (not illustrated), such as Optilon™ available from DuPont, may be positioned within the reflector 130. In some embodiments, portions of the LED mounting portion 100 may also be rendered reflective by these same methods.

Lens 150, having a first edge 152 and a second edge 154, is positioned adjacent the LED mounting portion 100 and the reflector 130. The LED mounting portion 100 includes a first slot 120 that receives the first edge 132 of the reflector 130 and a second slot 160 that receives the second edge 154 of the lens 150. The second edge 134 of the reflector 130 has a shelf 170 formed thereon and is snap-fitted over the first edge 152 of the lens 150. In this way, the LED mounting portion 100, the reflector 130, and the lens 150 are connected together to define a cavity 135, rendered reflective by virtue of the reflective inner surface 136 of the reflector 130. Other methods for connecting the LED mounting portion 100, reflector and/or lens 150 to each other are known and can be used in place of or in combination with the slots 120, 160 and shelf 170 described herein.

A plurality of LEDs 110 are mounted on the LED mounting portion 100 with screws 140 or other fastening mechanism. The LEDs 110 are mounted on a surface of the LED mounting portion 100 (usually, but not necessarily, via a printed circuit board) so as to direct emitted light into the reflective cavity 135. For ease of discussion, the light sources are referred to generally as LEDs 110. However, the LEDs referenced herein can be single-die or multi-die light emitting diodes, DC or AC, or can be an organic light emitting diodes (O-LEDs). While not required, strips of uniformly-spaced LEDs are particularly suitable for use in embodiments of the present invention.

The light from the LEDs 110 is directed toward the reflective inner surface 136 and mixed within the reflective cavity 135 and exits the cavity 135 through lens 150. In one embodiment, the lens 150 is clear and provided with no optical enhancements such that the light exiting the reflective cavity 135 passes directly through the lens 150. In other embodiments, the lens 150 can be refractive with symmetrical, asymmetrical, or non-symmetrical light output, include a diffractive optical element, or otherwise be tailored to produce the desired light output. The lens 150 could be made out of glass, acrylic, polycarbonate, or any other optically clear material. The lens may be contoured as desired for a particular application or straight.

End caps 400 may be positioned on each side of the luminaire 10 to enclose the reflective cavity 135 and impart a polished appearance to the luminaire 10. The end caps 400 may be formed of any suitable material, including but not limited to polymeric and metallic materials. In some embodiments, particularly those in which the displays are not refrigerated displays, it may be desirable to include apertures 600 in the end caps 400 through which heat generated by the LEDs 110 can escape, and/or through which electrical cables for powering the LEDs 110 can pass.

Figures 2, 3:
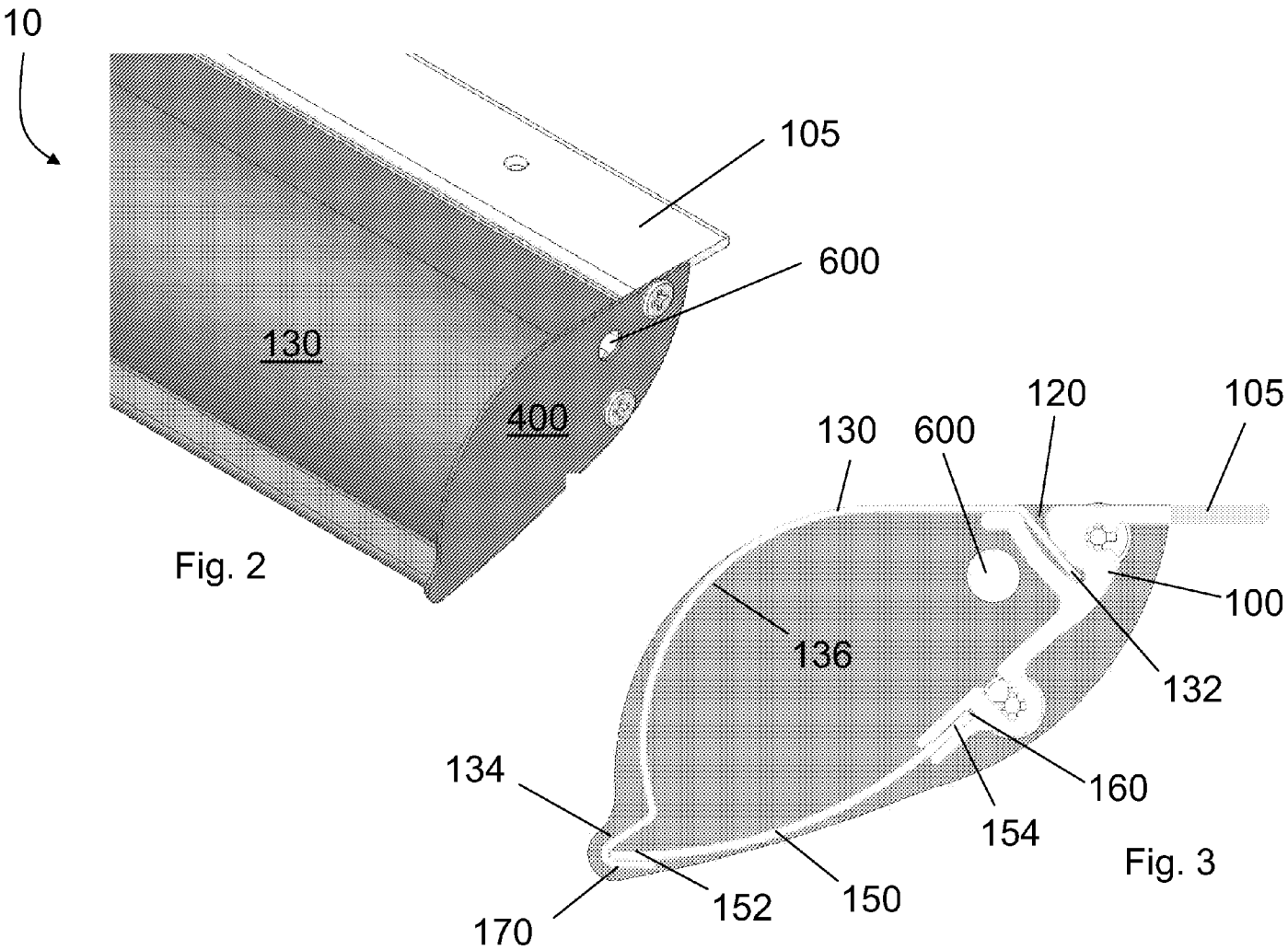
FIG. 2 is a partial perspective view of the luminaire of FIG. 1.
FIG. 3 is a cross-sectional view taken along line 3-3 in FIG. 1.
Figure 5:
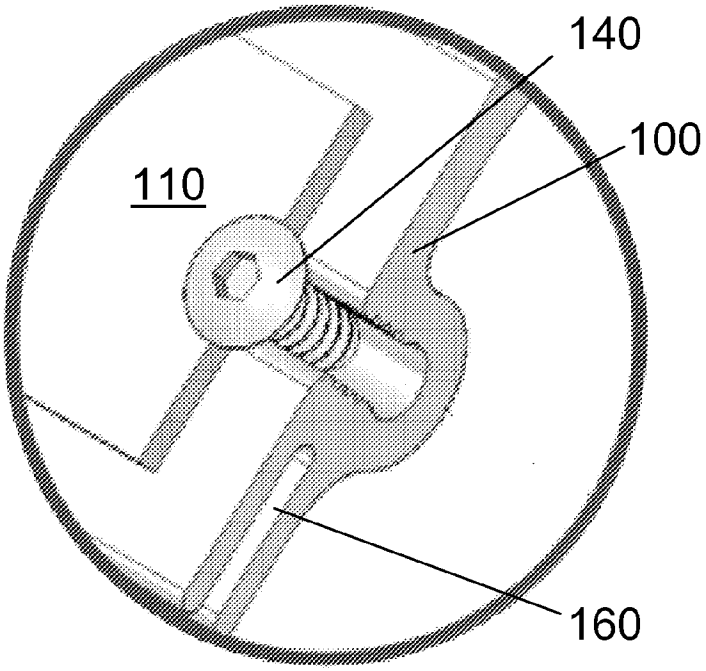
FIG. 5 is an enlarged section view taken at inset circle 5 in FIG. 4.
Figure 4:
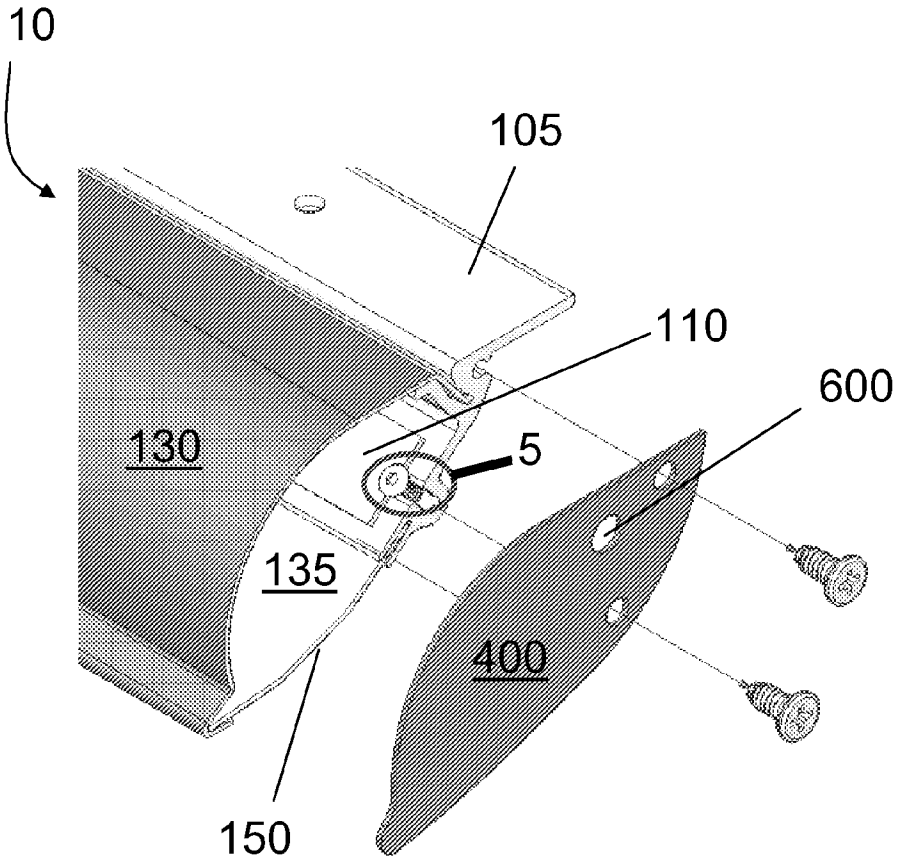
FIG. 4 is an exploded view of the luminaire of FIG. 2.
Figure 7:
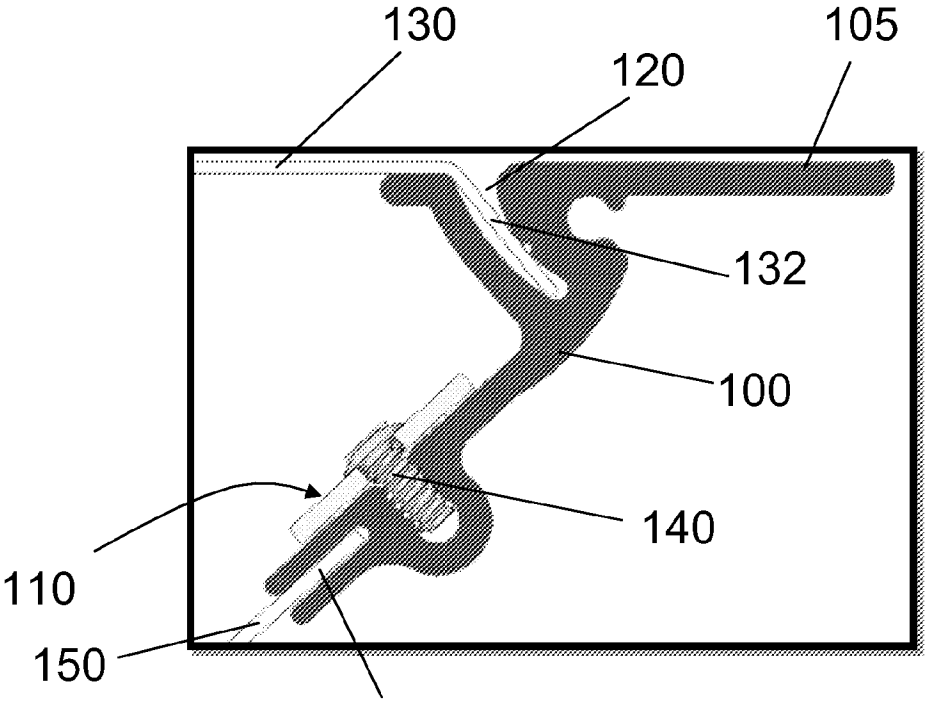
FIG. 7 is an enlarged section view taken at inset rectangle 7 in FIG. 6.
Figure 6:
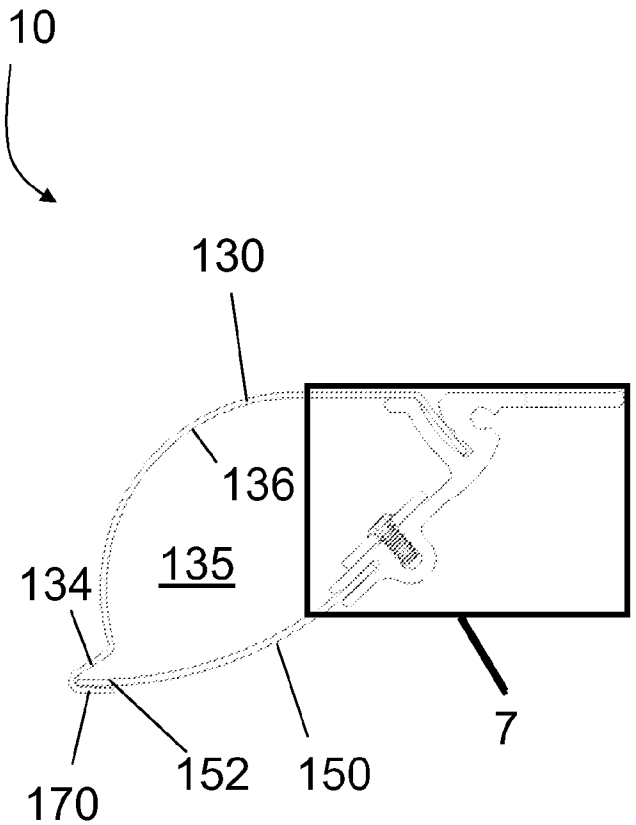
FIG. 6 is a cross-sectional view taken along line 6-6 in FIG. 1.
Figure 8:
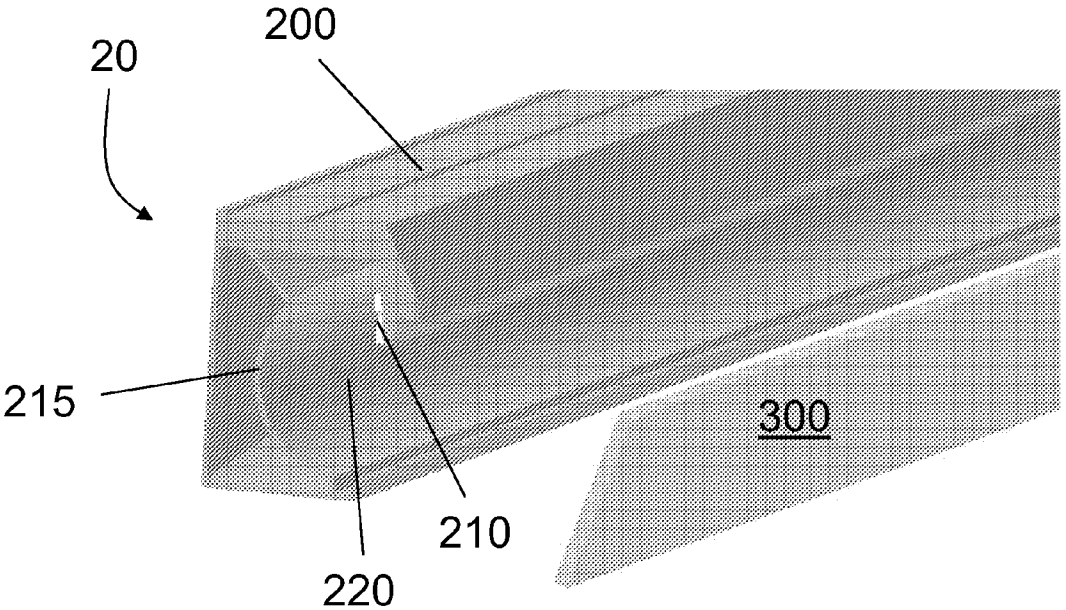
FIG. 8 is a partial front perspective view of a luminaire according to another embodiment of the invention.
Figure 9:
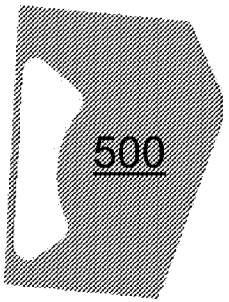
FIG. 9 is a side view of an end cap for the luminaire of FIG. 8.
Figure 10:
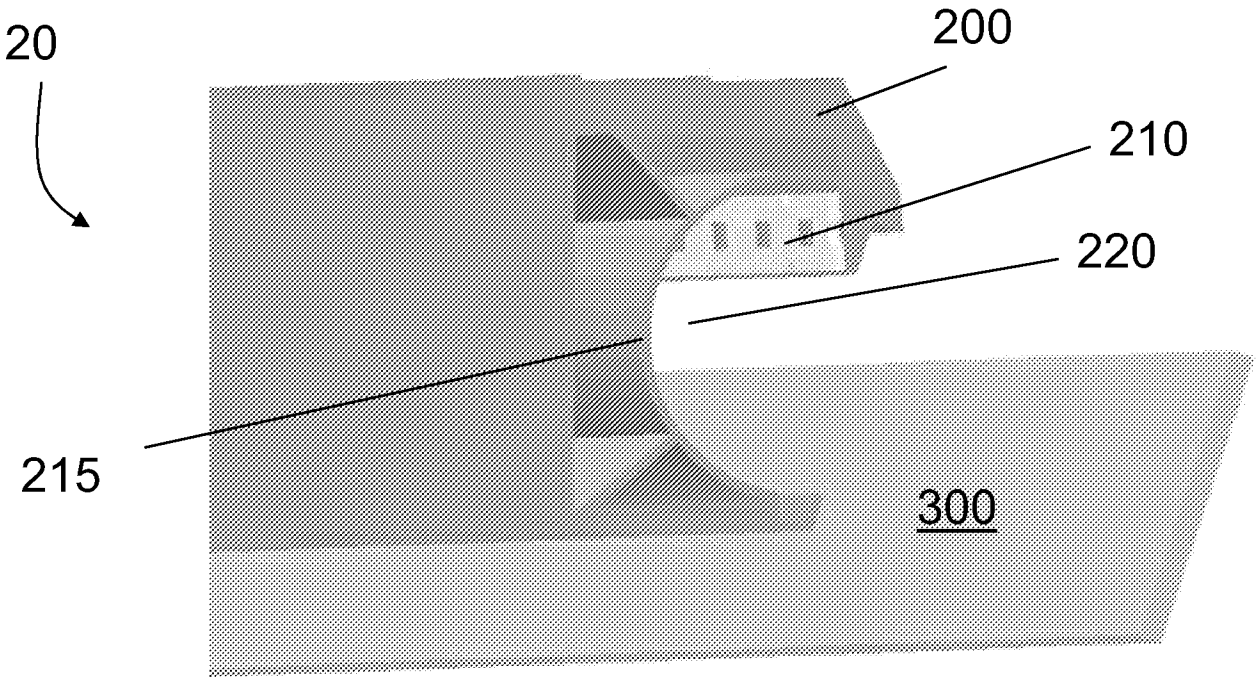
FIG. 10 is a partial back perspective view of the luminaire of FIG. 8.
Figure 11:
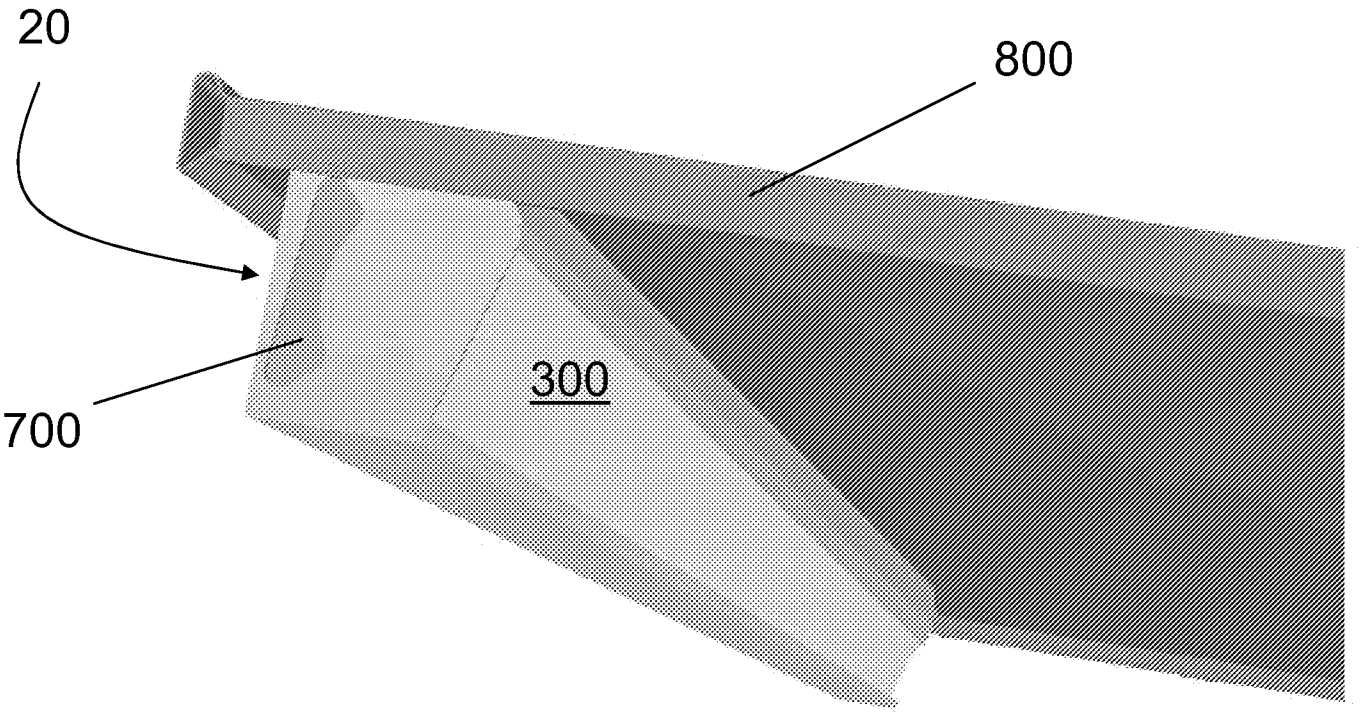
FIG. 11 is a perspective view of the luminaire of FIG. 8 installed on a shelf.

The luminaire can be attached to the display case shelves 800 in a variety of ways. In one embodiment, a ledge 105 is provided on the luminaire 10 (it can be, but does not have to be, formed integrally with the luminaire 10 as shown in FIG. 3) so that the luminaire 10 may be secured (e.g., via screws or other fasteners) to the shelf 800 via the ledge 105 (see exemplary FIG. 11). As discussed below, however, the luminaire may be secured on the shelf in a variety of different ways, all of which would be well known to one of skill in the art.

FIGS. 8-12 illustrate another embodiment of a luminaire 20 according to the present invention. The luminaire 20 includes an LED mounting portion 200 integrally formed with a reflector 215 and a lens 300. The LED mounting portion 200 and the reflector 215 can be formed of any suitable material such as a polymeric or metallic material but in some embodiments may be formed of extruded aluminum. The inner surface of the reflector is rendered diffusely reflective as described above. The lens 300 can be attached to the LED mounting portion 200 and reflector 215 in any manner, including by insertion of an edge 310 of the lens 300 within a groove 218 provided in the reflector 215 (see FIG. 12).

LEDs 210 according to exemplary embodiments described above are mounted on the LED mounting portion 200 with screws or other fastening mechanism as described above. The LEDs 210 are mounted on a surface of the LED mounting portion 200 so as to direct emitted light into the reflective cavity 220. The light from the LEDs 210 is mixed within the reflective cavity 220 and exits the cavity through lens 300. The lens 300 can be clear or be provided with optical enhancements as described above.

As described above, end caps 500 may be positioned on each end of the luminaire 20 to enclose the reflective cavity 220 and impart a polished appearance to the luminaire 20. The end caps 500 may be formed of any suitable material, including but not limited to polymeric and metallic materials.

Figure 13:
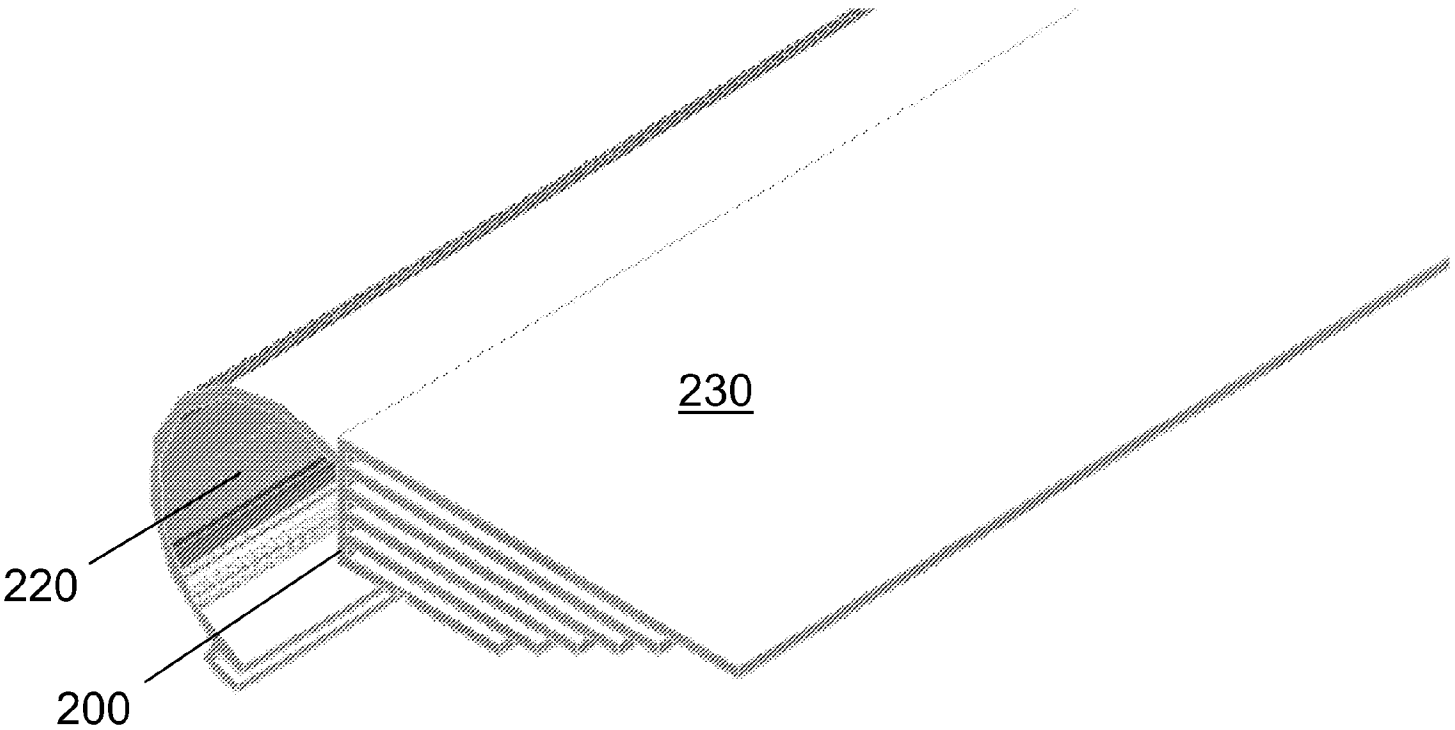
FIG. 13 is a top perspective view of a luminaire according to another embodiment of the invention.
Figure 14:
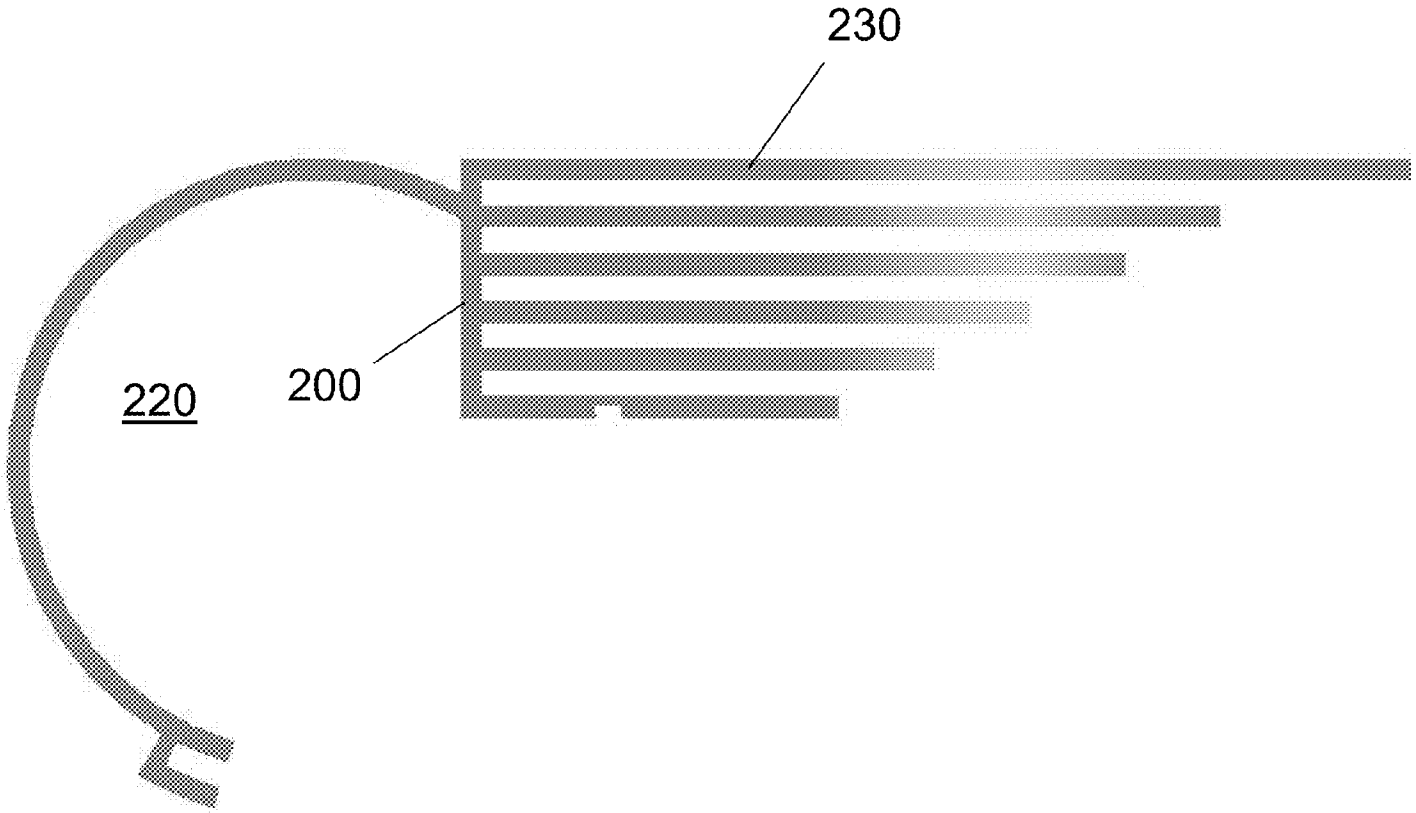
FIG. 14 is a side view of the luminaire of FIG. 13.
Figure 15:
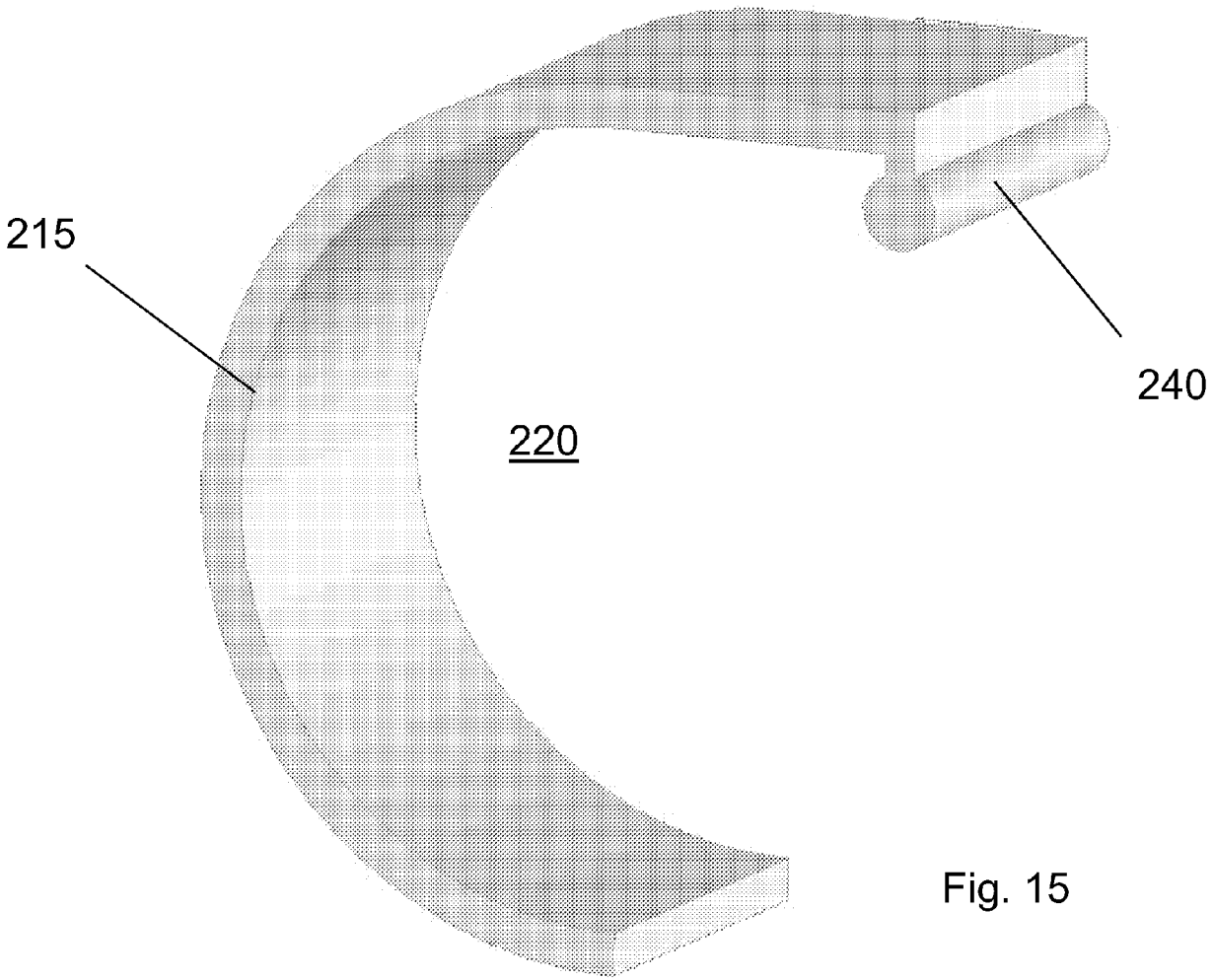
FIG. 15 is a top perspective view of a first portion of a luminaire according to one embodiment of the invention.
Figure 16:
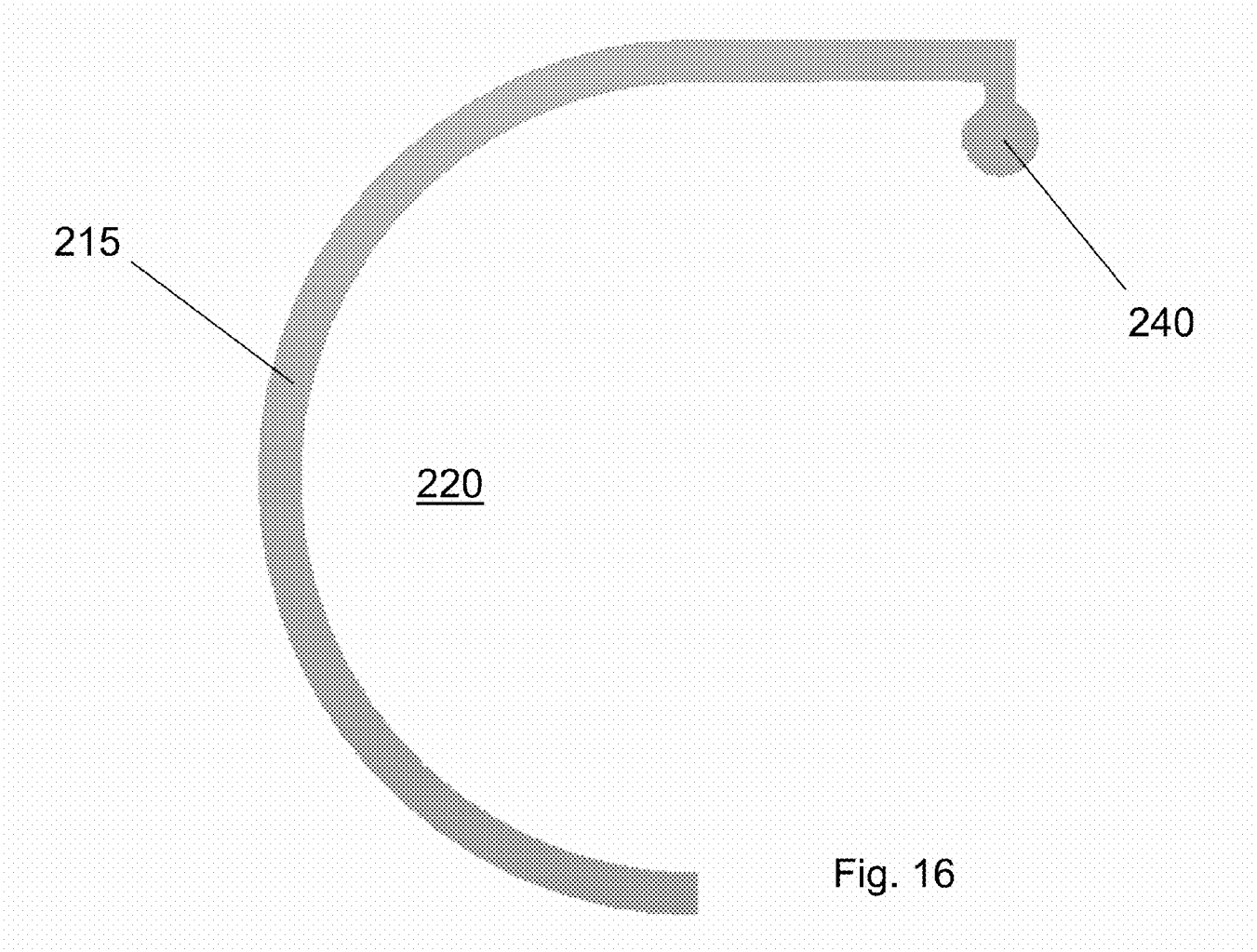
FIG. 16 is a side view of the first portion of FIG. 15.
Figure 17:
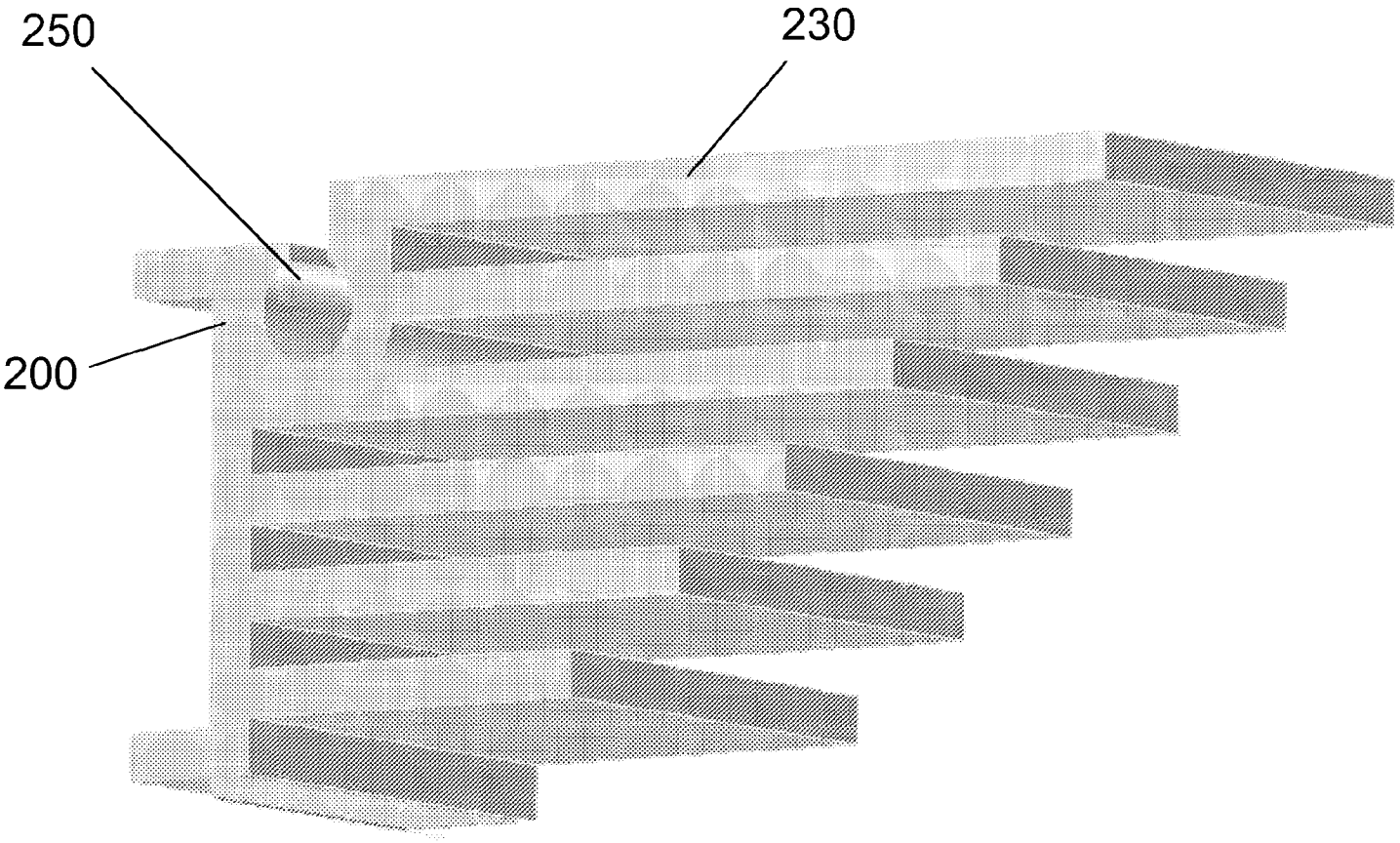
FIG. 17 is a bottom perspective view of a second portion of a luminaire for cooperation with the first portion of FIG. 15.
Figure 18:
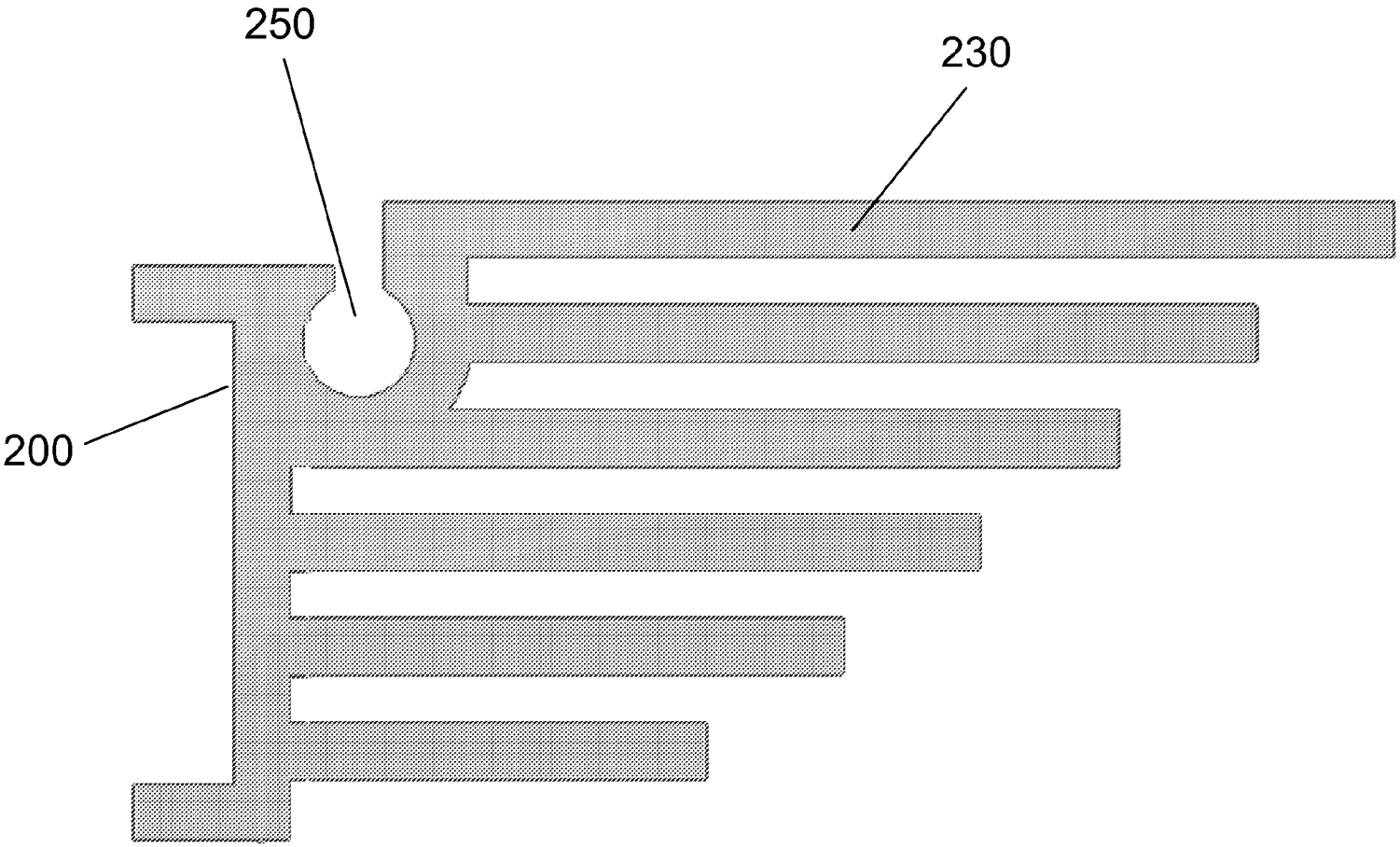
FIG. 18 is a side view of a second portion of FIG. 17.

In some embodiments, it may be desirable to provide fins 230 on the luminaire 10, to facilitate heat dissipation. See FIGS. 13 and 14. Where the luminaire 10, 20 is configured for use in a refrigerated display or other construction in which heat removal is not as much of a concern, the fins may optionally be omitted (as seen in exemplary embodiments described in FIGS. 1-12).

While FIGS. 8-14 illustrate an embodiment whereby the reflector 215 and LED mounting portion 200 are integrally-formed, they need not be. Rather, the reflector 215 and the LED mounting portion 200 may be formed separately and then connected together via any mechanical or chemical means. As shown in FIGS. 15-18, a ball 240 extending from one of the reflector 215 or the LED mounting portion 200 engages a socket 250 in the other of the reflector 215 or the LED mounting portion 200. In this way, an LED mounting portion 200 with or without fins 230 may be optionally attached to the reflector 215 depending on the intended use of the luminaire 20.

Figure 12:
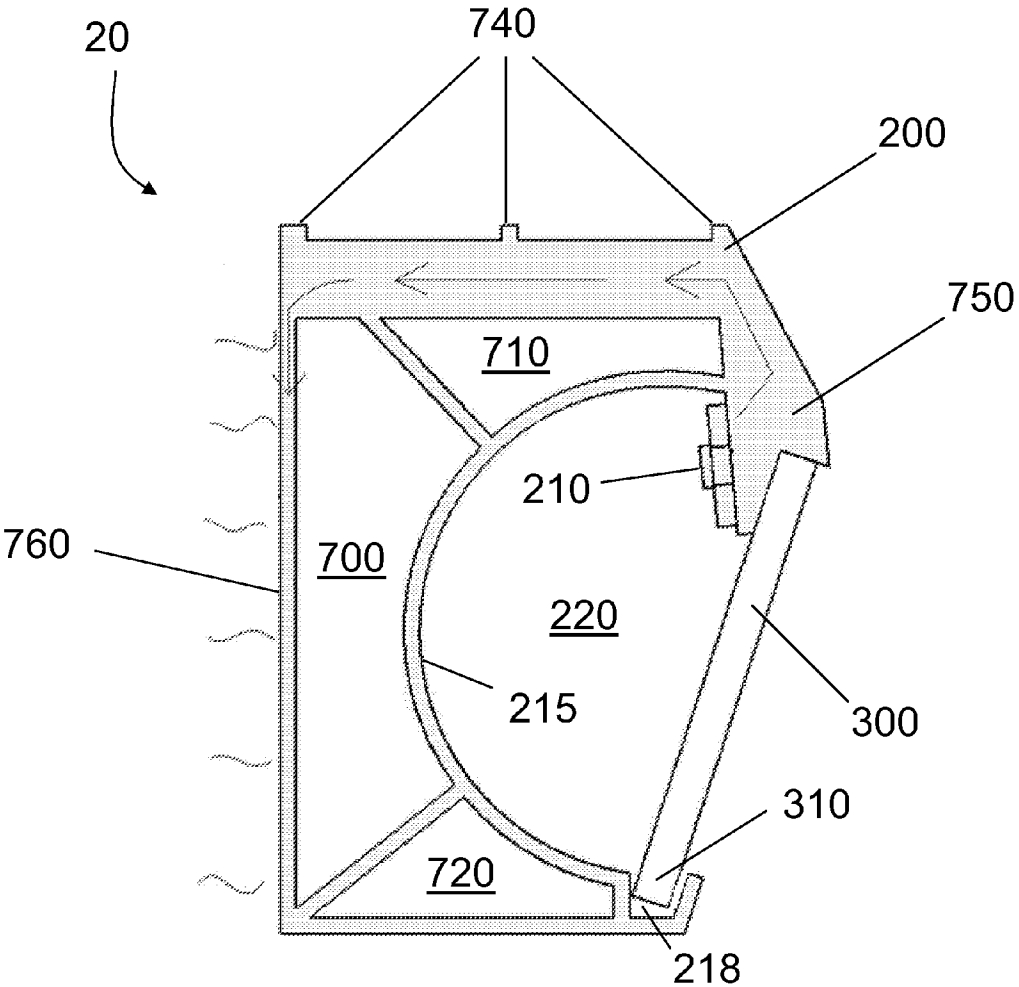
FIG. 12 is a cross-sectional view of the luminaire of FIG. 8.

As illustrated in more detail in FIG. 12, one or more voids 700, 710 and 720 may be provided along the length of the luminaire 20 to facilitate convective cooling. The luminaire 20 may also include one or more optional offsets 740 to minimize contact with the surface upon which the luminaire 20 is to be installed, which reduces heat flow to the surface upon which the luminaire 20 is installed. In addition, the portion of the LED mounting portion 200 onto which the LEDs 210 are installed can have a thickened section 750 to maximize the capacity of the LED mounting portion 200 to absorb and transfer heat from the LEDs 210. An LED mounting portion having voids 700, 710 and 720 and thick section 750 could be configured to distribute heat through the LED mounting portion and dissipate it through the back 760 of the luminaire 20. An exemplary illustration of heat flow from the LEDs 210 through the LED mounting portion 220 is shown by arrows in FIG. 12.

The luminaires described herein may be retro-fitted into existing refrigerated displays illuminated by fluorescent bulbs or may be installed in new units during assembly. While embodiments of the present invention are discussed for use with refrigerated display cases, such as open, multi-deck display cases, they are by no means so limited but rather may be used to illuminate products stored in any type of display case.

In use, the luminaire 10, 20 is attached to the end or underside of an existing display shelf 800. The luminaire may be secured to a shelf by any suitable retention method, including mechanical or chemical means. In one embodiment, the LED mounting portion 100, 200 of the luminaire 10, 20 acts as a mounting means and is adhered to the shelf 800. However, in other embodiments, mechanical fasteners or means for mechanically interlocking the luminaire 10, 20 with the shelf 800 may be used. In situations where the luminaire 10, 20 is not being retro-fitted into an existing display but rather incorporated into a display during manufacture, the luminaire 10, 20 (and particularly the LED mounting portion 100, 200 of the luminaire) may be formed integrally with the display shelves 800.

In use and once positioned as desired on a display shelf 800, the light emitted from the LEDs 110, 210 is directed into and mixed within the reflective cavity 135, 220. The light exiting the reflective cavity 135, 220 via the lens 150, 300 is uniform and directed towards the products being displayed on the display case (typically below) the luminaire 10, 20. In this way, the luminaire 10, 20 uniformly and indirectly illuminates the products.

Figure 19:
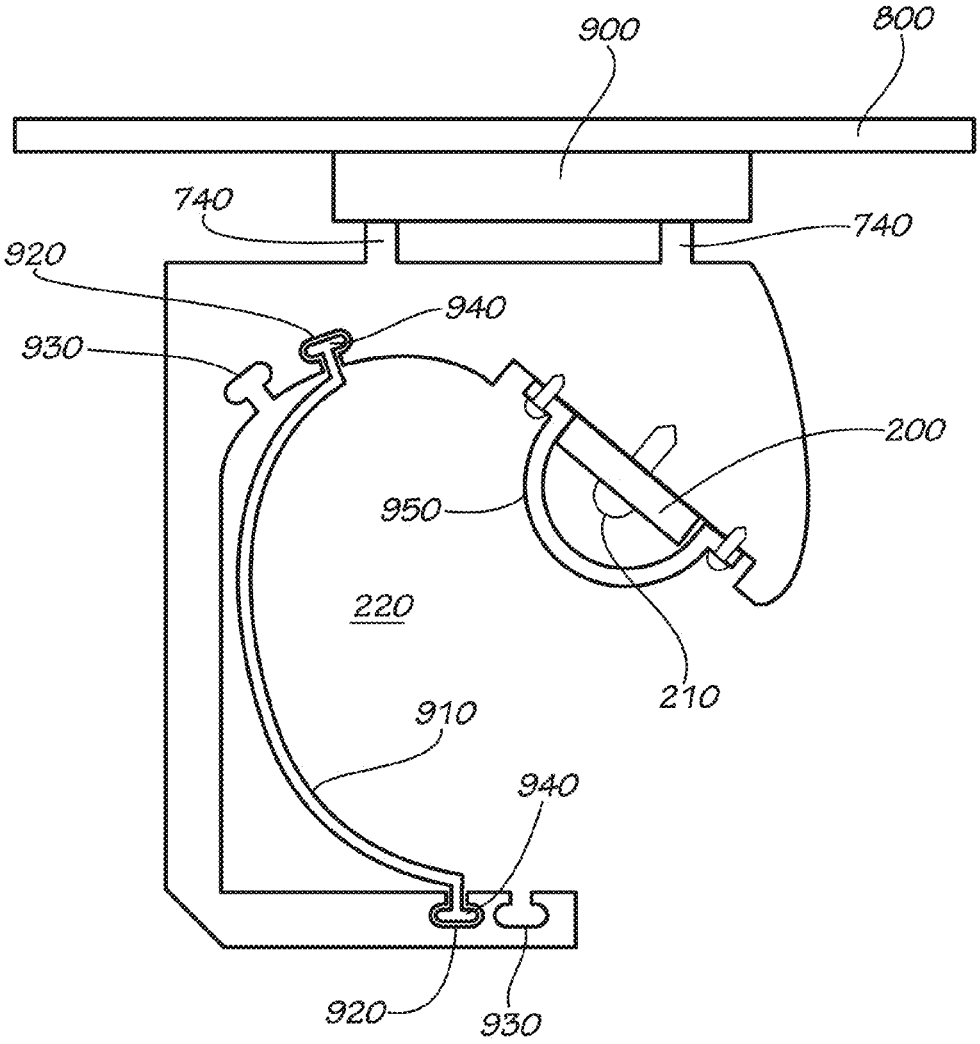
FIG. 19 is a side view of a luminaire according to an embodiment of the invention.

In yet other embodiments as illustrated in FIG. 19, the luminaire 10, 20 may be mounted on a thermal insulation pad 900 to reduce heat transfer from the luminaire to the shelf 800, which helps to keep the shelf 800 cool. The thermal insulation pad 900 may be formed of any suitable insulating material, including but not limited to acrylonitrile butadiene styrene (abs) plastic, nylon, and polycarbonate.

In other embodiments, the luminaire may include an adjustable reflector 910 that can be adjusted as desired to change the angle of light reflecting off the adjustable reflector 910 and out of the luminaire. In one embodiment, the luminaire may have multiple pairs of grooves 920, 930 into which ends 940 of the adjustable reflector 910 can be attached to allow the adjustable reflector 910 to be easily repositioned. Other methods for enabling the adjustable reflector 910 to be repositioned will be apparent to a person skilled in the art and are within the scope of this disclosure. The adjustable reflector 910 may be formed of a suitable polymeric or metallic material, and may have an inner surface that is rendered diffusely reflective as described above.

In other embodiments, an LED lens 950 can be attached directly to the LED mounting portion 100, 200 over the LEDs 110, 210. By mounting the LED lens directly on the LED mounting portion 100, 200, the lens 300 previously described herein may be eliminated, allowing the reflective cavity 135, 220 to be open, which provides additional heat dissipation capacity for the luminaire 10, 20.

Figure 20:
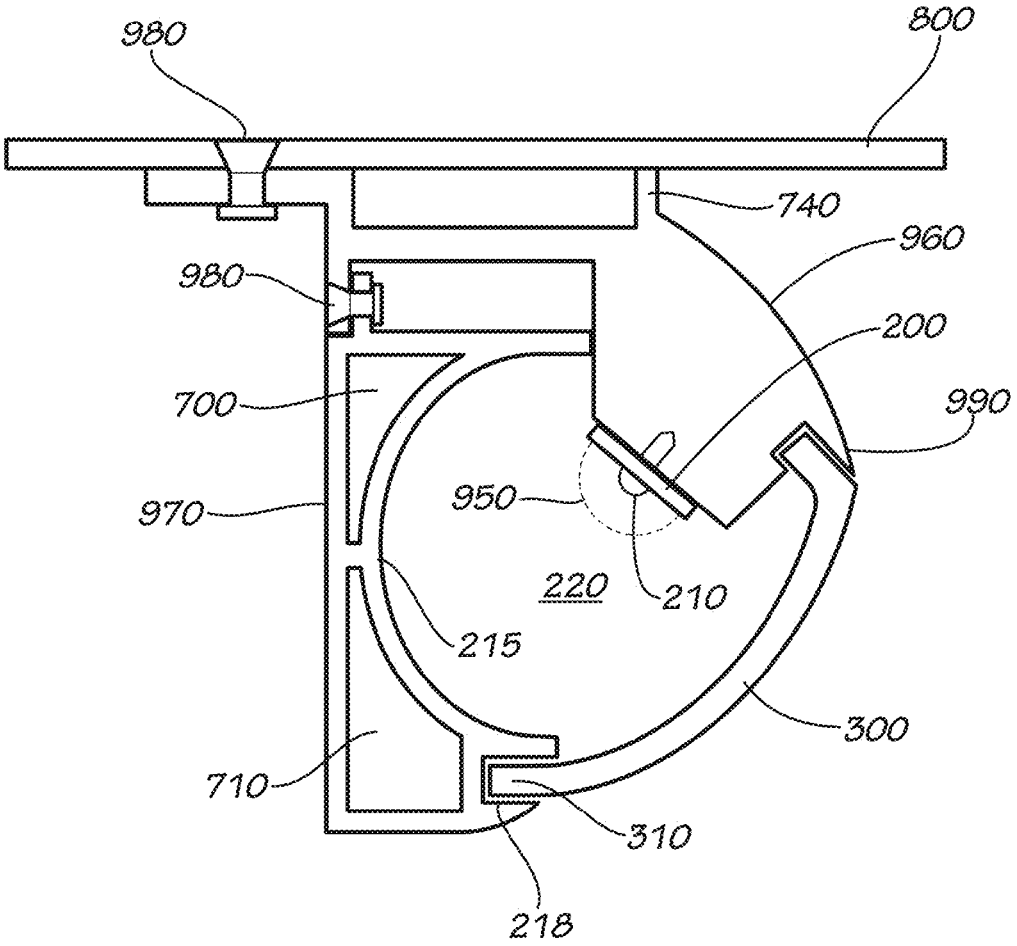
FIG. 20 is a side view of a luminaire according to one embodiment of the invention.

In further embodiments as illustrated in FIG. 20, the luminaire 10, 20 may be provided in a plurality of sections—for example a first section 960 and a second section 970—which may be fastened to each other, or to the shelf 800, with one or more fasteners. In one embodiment, the fasteners are countersunk rivets 980.

As illustrated, first section 960 may include the LED mounting portion 200, one or more LEDs 210, and one or more offsets 740. Second section 970 may include the reflector 215 and one or more voids 700, 710. The lens 300 may be affixed between the first section 960 and second section 970 in any manner. In one embodiment, one edge 310 of the lens 300 can be inserted into a groove 218 provided in the second section 970 and the other edge 302 of the lens can be inserted into a groove 304 provided in the first section 960.

When the luminaire 10, 20 is configured for placement in high-humidity environments, such as on a shelf 800 of a refrigerated display, it may be desirable to provide one or more surfaces of the luminaire 10, 20 with a water shedding edge 990 that will direct condensation away from the LEDs 110, 210 and off the luminaire 10, 20.

The luminaires 10, 20 need not use only white LEDs 110, 210. Rather color or multicolor LEDs 110, 210 may be provided. Nor must all of the LEDs 110, 210 within a luminaire 10, 20 or within an LED array be the same color. With colored discrete or multicolor die LEDs, it is possible to select a variety of colors with which to illuminate the display or to program specific colors for each section of the display. In this way, LEDs 110, 210 of different temperatures may be selected and their emitted light blended within the reflective cavity 135, 220 so that the resulting blended light is tailored to improve product color rendering. Thus, the indirect light emitted from the luminaire 10, 20 may be customized depending on the product being illuminated.

To conserve energy and associated costs, the luminaire 10, 20 need not be illuminated at all times or be illuminated the same at all times. Moreover, not all of the LEDs 110, 210 need be illuminated at the same time, but rather one can selectively illuminate some or all of the LEDs as desired. For example, the LEDs 110, 210 could be programmed to turn off at night.

Ultraviolet LEDs 110, 210 may be used to reduce energy costs during non-peak times. During these times, the ultraviolet LEDs would illuminate fluorescent materials on the products or refrigerated unit labels. Such ultraviolet LEDs may be used to create a glowing affect that would make graphics strikingly visible in the dark.

The foregoing is provided for purposes of illustrating, explaining, and describing embodiments of the present invention. Further modifications and adaptations to these embodiments will be apparent to those skilled in the art and may be made without departing from the scope or spirit of the invention.

We claim:

1. A luminaire comprising:

an LED mounting portion comprising a plurality of LEDs mounted thereon;

a reflector; and a lens, wherein the LED mounting portion and reflector are sized and arranged to form a reflective cavity for diffusing and directing light from the plurality of LEDs through the lens and out of the luminaire, wherein the lens is held in place in the luminaire between the LED mounting portion and the reflector or is mounted directly on the LED mounting portion over the plurality of LEDs, and wherein the reflector is repositionable within the luminaire so as to allow the direction of light exiting the luminaire to be adjusted.

2. The luminaire of claim 1, wherein the luminaire is mounted on a shelf of a display.

3. The luminaire of claim 2, wherein a thermal insulation pad is located between the luminaire and the shelf.

4. The luminaire of claim 1, wherein the LED mounting portion and reflector are separate components and are removably attached to each other.

5. The luminaire of claim 4, wherein the LED mounting portion and reflector are attached to each other with one or more countersunk rivets.

6. The luminaire of claim 1, wherein the luminaire is attached to a shelf of a display with one or more countersunk rivets.

7. The luminaire of claim 1, wherein one or more surfaces of the luminaire have a water shedding surface for directing condensation away from the plurality of LEDs and off the luminaire.

8. A luminaire comprising:

an LED mounting portion comprising a plurality of LEDs mounted thereon;

a reflector;

a lens; and a thermal insulation pad for mounting the luminaire to a surface, wherein the LED mounting portion and reflector are sized and arranged to form a reflective cavity for diffusing and directing light from the plurality of LEDs through the lens and out of the luminaire, and wherein the reflector is repositionable within the luminaire so as to allow the direction of light exiting the luminaire to be adjusted.

9. The luminaire of claim 8, wherein the surface is a shelf of a refrigerated display.

10. A luminaire comprising:

an LED mounting portion comprising a plurality of LEDs mounted thereon;

a reflector; and a lens, wherein the LED mounting portion and reflector are sized and arranged to form a reflective cavity for diffusing and directing light from the plurality of LEDs through the lens and out of the luminaire, and wherein the reflector is repositionable within the luminaire so as to allow the direction of light exiting the luminaire to be adjusted.

11. The luminaire of claim 1, wherein the luminaire comprises at least a first pair of grooves and a second pair of grooves, wherein the reflector may be retained by the first pair of grooves to reflect light out of the luminaire in a first direction and wherein the reflector may be retained by the second pair of grooves to reflect light out of the luminaire in a second direction different from the first direction.

12. The luminaire of claim 8, wherein the luminaire comprises at least a first pair of grooves and a second pair of grooves, wherein the reflector may be retained by the first pair of grooves to reflect light out of the luminaire in a first direction and wherein the reflector may be retained by the second pair of grooves to reflect light out of the luminaire in a second direction different from the first direction.

13. The luminaire of claim 10, wherein the luminaire comprises at least a first pair of grooves and a second pair of grooves, wherein the reflector may be retained by the first pair of grooves to reflect light out of the luminaire in a first direction and wherein the reflector may be retained by the second pair of grooves to reflect light out of the luminaire in a second direction different from the first direction.

* * * * *